US011847960B2

(12) United States Patent
Xiong et al.

(10) Patent No.: US 11,847,960 B2
(45) Date of Patent: Dec. 19, 2023

(54) DISPLAY PANEL, METHOD FOR DRIVING THE SAME, AND DISPLAY APPARATUS

(71) Applicants: WUHAN TIANMA MICROELECTRONICS CO., LTD., Wuhan (CN); Wuhan Tianma Microelectronics Co., Ltd. Shanghai Branch, Shanghai (CN)

(72) Inventors: Zhiyong Xiong, Wuhan (CN); Yaolin Wang, Wuhan (CN)

(73) Assignees: WUHAN TIANMA MICROELECTRONICS CO., LTD., Wuhan (CN); Wuhan Tianma Microelectronics Co., Ltd. Shanghai Branch, Pudong New District (CN)

( * ) Notice: Subject to any disclaimer, the term of this patent is extended or adjusted under 35 U.S.C. 154(b) by 0 days.

(21) Appl. No.: 17/842,385

(22) Filed: Jun. 16, 2022

(65) Prior Publication Data

US 2022/0327993 A1 Oct. 13, 2022

(30) Foreign Application Priority Data

Mar. 31, 2022 (CN) ..... 202210342814.8

(51) Int. Cl.
*G09G 3/32* (2016.01)

(52) U.S. Cl.
CPC ..... *G09G 3/32* (2013.01); *G09G 2300/0421* (2013.01); *G09G 2310/0262* (2013.01); *G09G 2310/08* (2013.01)

(58) Field of Classification Search
CPC ..... G09G 2310/0262; G09G 2310/08; G09G 3/32; G09G 2300/0417; G09G 2300/0819; G09G 2320/0238; G09G 2310/0251; G09G 2320/0247; G09G 2320/045; G09G 2340/0435; G09G 3/3225; G09G 3/3266;
(Continued)

(56) References Cited

U.S. PATENT DOCUMENTS 8,040,297 B2 * 10/2011 Chung ..... G09G 3/3266 315/169.3
2001/0045929 A1 * 11/2001 Prache ..... G09G 3/3233 345/89

(Continued)

FOREIGN PATENT DOCUMENTS

CN 102982764 A 3/2013
CN 112365849 A 2/2021
CN 113257196 A 8/2021

OTHER PUBLICATIONS

Chinese Office Action dated Nov. 18, 2022, issued in related Chinese Application No. 202210342814.8 filed Mar. 31, 2018(date), 19 pages.

*Primary Examiner* — Muhammad N Edun
(74) *Attorney, Agent, or Firm* — Christensen O'Connor Johnson Kindness PLLC

(57) ABSTRACT

The present disclosure provides a display panel, a method for driving the display panel, and a display apparatus. The display panel includes multiple pixel circuits. The pixel circuit includes a drive transistor and at least one switch unit. At least one switch unit includes M thin film transistors connected in parallel, and M is a positive integer greater than or equal to 2. The M thin film transistors are configured to be turned on during different display phases, respectively.

19 Claims, 13 Drawing Sheets

(58) Field of Classification Search
CPC ..... G09G 2300/0421; G09G 2230/00; G09G 2310/0216; G09G 2300/0895; G09G 3/3241; H10K 59/12; H10K 59/1213
See application file for complete search history.

(56) References Cited

U.S. PATENT DOCUMENTS

| | | | | |
|---|---|---|---|---|
| 2004/0056604 | A1* | 3/2004 | Shih | G09G 3/3241 315/169.3 |
| 2004/0196223 | A1* | 10/2004 | Kwon | G09G 3/3233 345/82 |
| 2021/0335953 | A1* | 10/2021 | Kim | H10K 59/131 |

* cited by examiner

DISPLAY PANEL, METHOD FOR DRIVING THE SAME, AND DISPLAY APPARATUS

CROSS-REFERENCE TO RELATED APPLICATION

The present application claims priority to Chinese Patent Application No. 202210342814.8, filed on Mar. 31, 2022, the content of which is incorporated herein by reference in its entirety.

TECHNICAL FIELD

The present disclosure relates to the field of display technologies, and, particularly, relates to a display panel, a method for driving a display panel, and a display apparatus.

BACKGROUND

An organic light emitting diode (OLED) display panel includes a pixel circuit and a light-emitting element that are electrically connected to each other. The pixel circuit is configured to transmit a driving current to the light-emitting element to drive the light-emitting element to emit light.

However, based on the structure of the pixel circuit in the related art, when the display panel is refreshed at a higher frequency, the operating frequency of the transistors in the pixel circuit is correspondingly higher, resulting in higher power consumption of the transistors.

SUMMARY

In a first aspect, the present disclosure provides a display panel. The display panel includes a plurality of pixel circuits. Each pixel circuit comprises: a drive transistor, and at least one switch unit comprising M thin film transistors connected in parallel, where M is a positive integer greater than or equal to 2. The M thin film transistor is configured to be turned on during different display phases.

In a second aspect, the present disclosure provides a method for driving a display panel, which is configured to drive the above display panel. The method includes: controlling the pixel circuit to drive a light-emitting element to emit light, and during operation of the pixel circuit, controlling the M thin film transistors in the switch unit to be turned on during the different display phases, respectively.

In a third aspect, the present disclosure provides a display apparatus. The display apparatus includes the display panel as above.

BRIEF DESCRIPTION OF DRAWINGS

In order to more clearly illustrate technical solutions of embodiments of the present disclosure, the accompanying drawings used in the embodiments are briefly described below. The drawings described below are merely a part of the embodiments of the present disclosure. Based on these drawings, those skilled in the art can obtain other drawings.

DESCRIPTION OF EMBODIMENTS

In order to better understand the technical solutions of the present disclosure, the embodiments of the present disclosure are described in detail below with reference to the accompanying drawings.

It should be clear that the described embodiments are only a part of the embodiments of the present disclosure, but not all of the embodiments. Based on the embodiments in the present disclosure, all other embodiments obtained by those of ordinary skill in the art fall within the protection scope of the present disclosure.

The terms used in the embodiments of the present disclosure are only for the purpose of describing specific embodiments, and are not intended to limit the present disclosure. As used in the embodiments of this application and the appended claims, the singular forms "a," "the," and "the" are intended to include the plural forms as well, unless the context clearly dictates otherwise.

It should be understood that the term "and/or" used in this document is only an association relationship to describe the associated objects, indicating that there can be three relationships, for example, A and/or B, which can indicate that A alone, A and B, and B alone. The character "/" in the present description generally indicates that the related objects are an "or" relationship.

It should be understood that although the terms 'first', 'second', and 'third' can be used in the present disclosure to describe thin film transistors, these thin film transistors should not be limited to these terms. These terms are used only to distinguish the thin film transistors from each other. For example, without departing from the scope of the embodiments of the present disclosure, a first thin film transistor can also be referred to as a second thin film transistor. Similarly, the second thin film transistor can also be referred to as the first thin film transistor.

Figure 1:
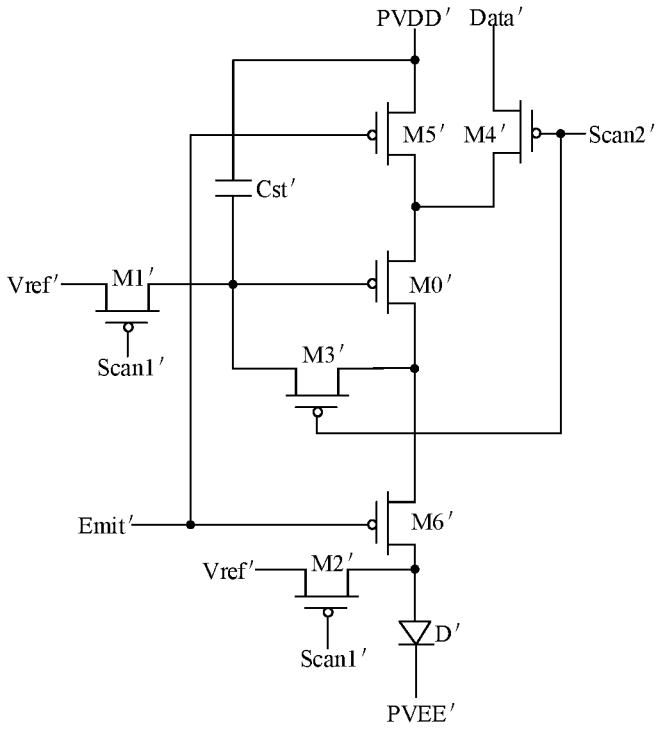
FIG. 1 is a schematic diagram of a pixel circuit in the related art.

In order to illustrate the technical solution provided by the present disclosure more clearly, the present disclosure first takes the pixel circuit shown in FIG. 1 as an example to describe the operating principle of the pixel circuit.

FIG. 1 is a schematic diagram of a pixel circuit in the related art. As shown in FIG. 1, the pixel circuit includes a driving transistor M0', a gate reset transistor M1', an anode reset transistor M2', a data writing transistor M4', a threshold compensation transistor M3', a first light-emitting control transistor M5', a second light-emitting control transistor M6', and a storage capacitor Cst'.

Figure 2:
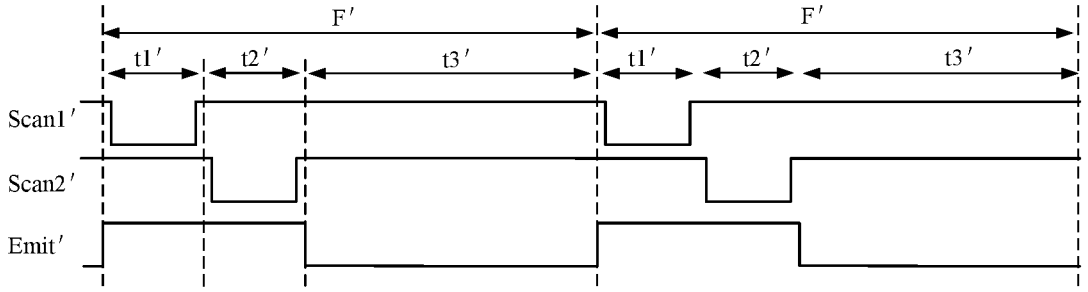
FIG. 2 is a timing sequence corresponding to FIG. 1.

With reference to a timing sequence shown in FIG. 2, the pixel circuit sequentially executes a reset phase t1', a data writing phase t2' and a light-emitting control phase t3' within a frame period F'.

During the reset phase t1', the gate reset transistor M1' and the anode reset transistor M2' each respond to a first scanning signal provided by a first scanning signal line Scan1', and a reset signal provided by a reset signal line Vref' is written to a gate electrode of the driving transistor M0' and an anode of the light-emitting element D', to reset the gate electrode of the driving transistor M0' and the anode of the light-emitting element D'.

During the data writing phase t2', the data writing transistor M4' and the threshold compensation transistor M3' respond to a second scanning signal provided by a second scanning signal line Scan2', and a data signal provided by a data line Data' is written to the gate electrode of the driving transistor M0', so as to compensate a threshold of the drive transistor M0'.

During the light-emitting control stage t3', the first light-emitting control transistor M5' and the second light-emitting control transistor M6' respond to a light-emitting control signal provided by a light-emitting control signal line Emit' to control a signal transmission path between a power supply signal line PVDD' and an anode of the light-emitting element D' to be turned on, and a driving current converted by the driving transistor M0' is transmitted to the light-emitting element D', so as to drive the light-emitting element D' to emit light.

Based on the circuit structure of the pixel circuit in the related art, the operating frequency of the transistors in the pixel circuit is consistent with a refresh rate of the display panel. Each time the display panel is refreshed, the transistors in the pixel circuit operate once. For example, when the display panel is refreshed at 120 Hz, the operating frequency of the transistor in the pixel circuit is also 120 Hz. In this way, when the display panel is refreshed at a high frequency or an ultra-high frequency in application scenarios such as games and high frame rate videos, the operating frequency of each transistor in the pixel circuit also needs to be increased, resulting in a higher power consumption of the transistor, thereby affecting the performance of the display panel.

Figure 3:
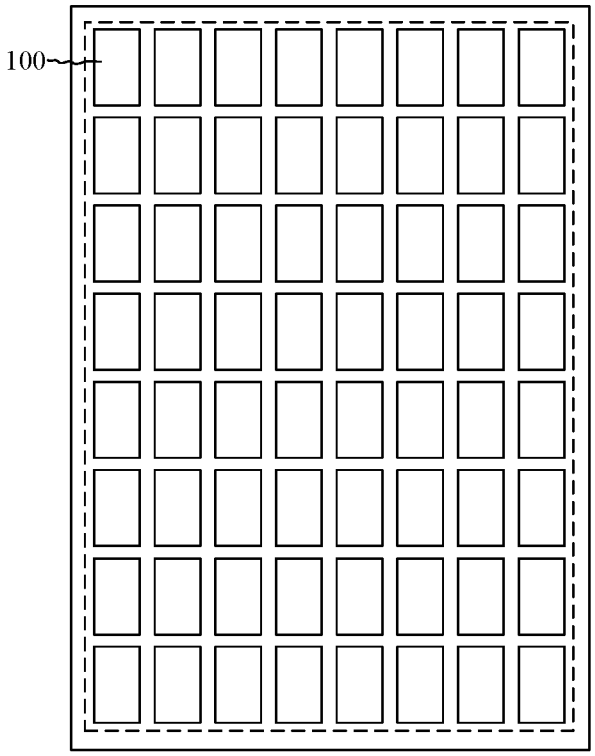
FIG. 3 is a schematic diagram of a display panel provided by an embodiment of the present disclosure.
Figure 4:
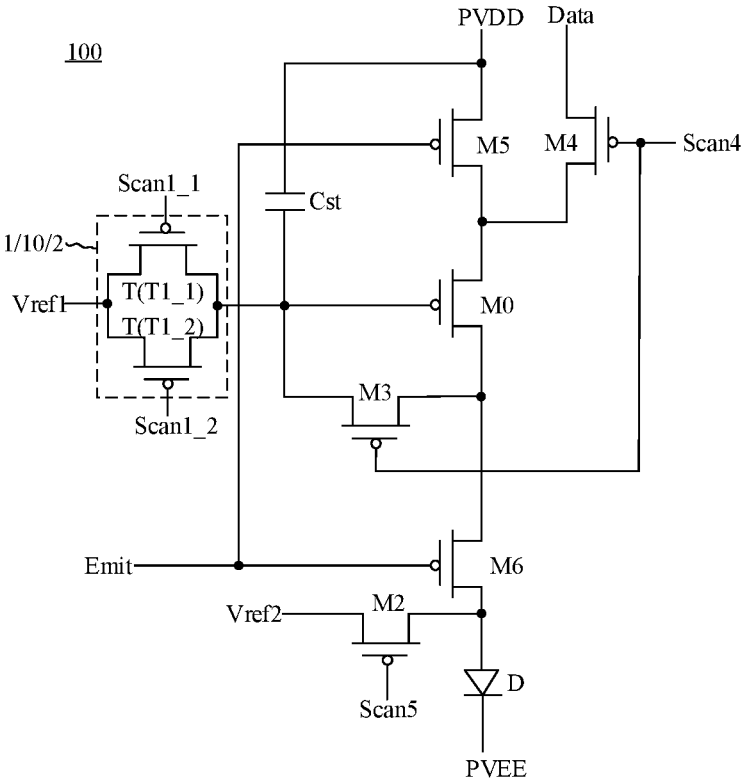
FIG. 4 is a schematic diagram of a display panel provided by an embodiment of the present disclosure.

An embodiment of the present disclosure provides a display panel. FIG. 3 is a schematic diagram of a display panel in an embodiment of the present disclosure, and FIG. 4 is a schematic diagram of a display panel in an embodiment of the present disclosure. As shown in FIG. 3 and FIG. 4, the display panel includes multiple pixel circuits 100. The pixel circuit 100 includes a driving transistor M0 and at least one switch unit 1.

The at least one switch unit 1 includes M thin film transistors T connected in parallel, where M is a positive integer greater than or equal to 2. The M thin film transistors T are configured to be respectively turned on during different display phases.

It should be understood that the display phase in an embodiment of the present disclosure can be an integral multiple of a frame period. For example, the display phase can include a frame period or multiple adjacent frame periods. By setting the display phase to be an integral multiple of the frame period, the M thin film transistors T can operate in a preset turn-on sequence.

Taking the switch unit 1 including two thin film transistors T connected in parallel as an example, when the display phase includes a frame period, a first one of the two thin film transistors T is turned on during an odd-numbered frame period, and a second one of the two thin film transistors T is turned on during an even-numbered frame period. When the display phase includes adjacent m frames, the two thin film transistors T can be turned on in the following sequence. That is, the first one of the two thin film transistors T is turned on during a first frame period to an $m^{th}$ frame period, the second one of the two thin film transistors T is turned on during an $(m+1)^{th}$ frame period to a $(2m)^{th}$ frame period, the first one of the two thin film transistors T is turned on during a $(2m+1)^{th}$ frame period to $(3m)^{th}$ frame period, the second one of the two thin film transistors T is turned on during a $(3m+1)^{th}$ frame period to $(4m)^{th}$ frame period, and so on.

In the embodiments of the present disclosure, the multiple thin film transistors T in the switch unit 1 are connected in parallel and are respectively turned on in different display phases, so that each thin film transistor T can be turned on only in at least one display phase of the display phases and can be turned off in at least one another display phase of the display phases. Exemplarily, when M=2 and when the two thin film transistors T operate in the turn-on sequence, that is, the first one of the two thin film transistors T of the two thin film transistors T is turned on during the odd-numbered frame period, and the second one of the two thin film transistors T of the two thin film transistors T is turned on during the even-numbered frame period, each thin film transistor T operates only once during two frame periods, that is, the operating frequency of a single thin film transistor T is only a half of the refresh rate of the display panel. When the display panel is refreshed at a high frequency of 120 Hz, the operating frequency of a single thin film transistor T is only 60 Hz, and the operating frequency of the thin film transistor T is reduced.

To sum up, by using technical solutions provided by the embodiments of the present disclosure, the operating frequency of the thin film transistor T in the pixel circuit 100 can be smaller than the refresh rate of the display panel. Even though the display panel can be refreshed at a high frequency, these thin film transistors T can also operate at a lower frequency, thereby reducing the power consumption of these thin film transistors T and thus reducing an overall power consumption of the pixel circuit 100.

In other words, since the operating frequency of the thin film transistor T in the embodiments of the present disclosure does not need to be consistent with the refresh rate of the display panel, so that the refresh rate of the display panel can be increased while ensuring that the power consumption of the thin film transistor T remains low, thereby improving the display effect.

Generally speaking, referring to FIG. 1 again, the transistors in the pixel circuit are mostly low temperature poly-silicon (LTPS) transistors. However, in order to reduce the influence of the off-state leakage current of the transistor on the light-emitting brightness of the light-emitting element, in the related art, some transistors in the pixel circuit 100 are usually the oxide transistors having lower electron mobility and smaller off-state leakage current, such as indium gallium zinc oxide (IGZO) transistors.

Figure 5:
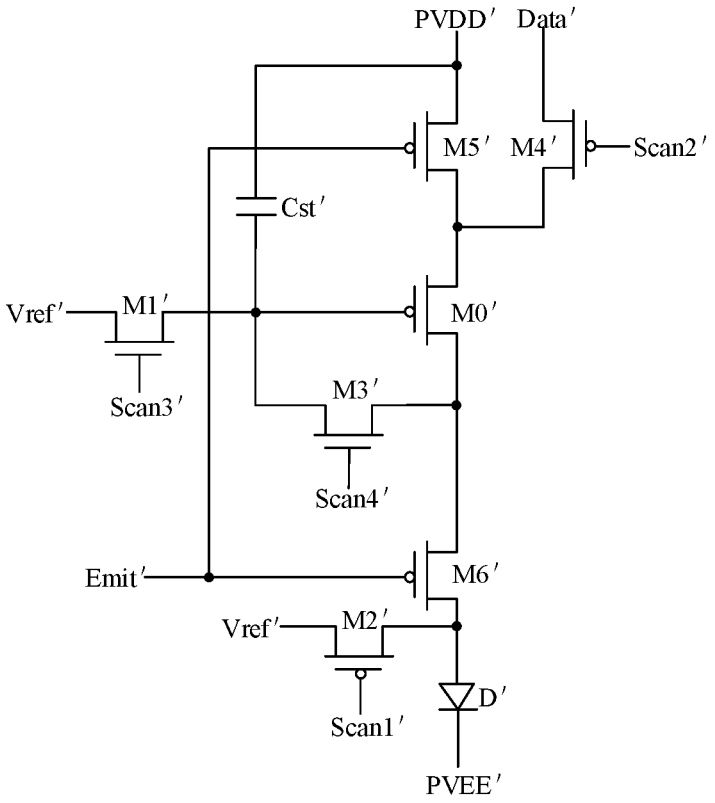
FIG. 5 is another schematic diagram of a pixel circuit in the related art.
Figure 6:
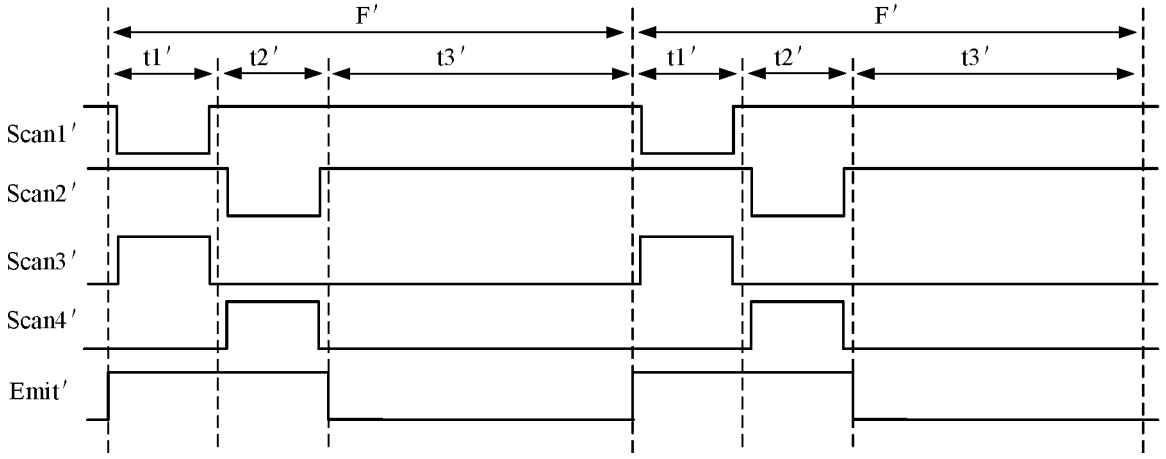
FIG. 6 is a timing sequence corresponding to FIG. 5.

FIG. 5 is another schematic diagram of a pixel circuit in the related art, and FIG. 6 is a timing sequence corresponding to FIG. 5. Exemplarily, as shown in FIG. 5 and FIG. 6, the gate reset transistor M1' and threshold compensation transistor M3' in the pixel circuit can be IGZO transistors. At this time, the gate electrode of the gate reset transistor M1' is electrically connected to a single third scanning signal line Scan3', and the threshold compensation transistor M3' is electrically connected to a single fourth scanning signal line Scan4'.

However, based on the device characteristics of the relevant oxide transistors, although the power consumption of the oxide transistors is lower at low refresh rates, the power consumption of the oxide transistors at high refresh rates is higher than the power consumption of the low temperature poly-silicon transistors at the high refresh rates. For example, when the oxide transistors and the low temperature poly-silicon transistor operates at a frequency of 120 Hz, the power consumption of the oxide transistor will be significantly higher than the power consumption of the low temperature poly-silicon transistor. Therefore, in the related art, only some low temperature poly-silicon transistors can be replaced with oxide transistors. Although the influence of the off-state leakage current on circuit operation stability can be reduced, the problem of high power consumption of oxide transistors under a high-frequency refresh occurs.

Figure 7:
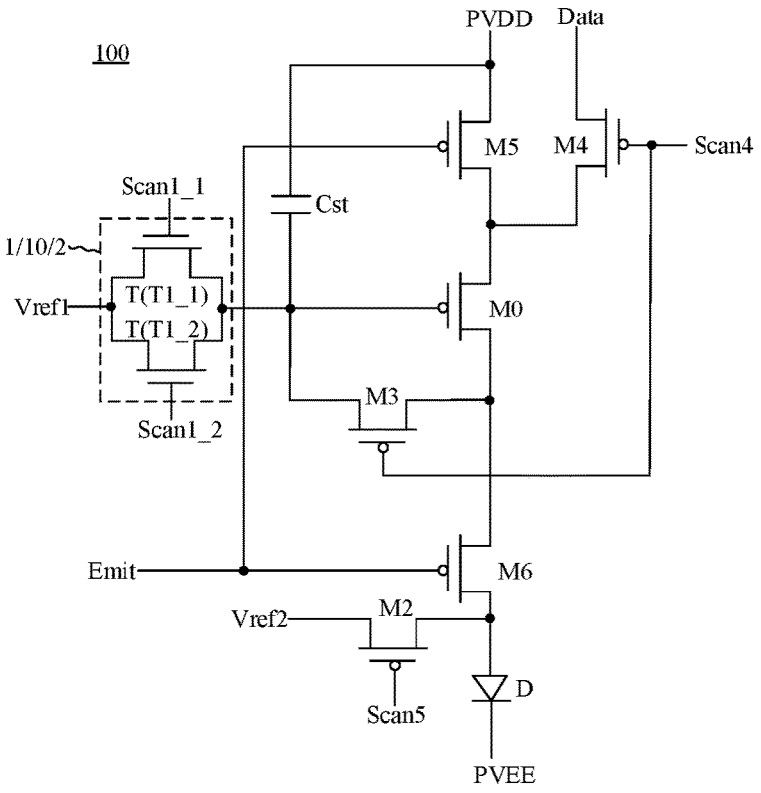
FIG. 7 is a schematic diagram of a pixel circuit provided by another embodiment of the present disclosure.

In this regard, in an embodiment of the present disclosure, as shown in FIG. 7 that is a schematic diagram of a pixel circuit provided by another embodiment of the present disclosure, the thin film transistor T in the switch unit 1 can be an oxide transistor, that is, an active layer of the thin film transistor T includes an oxide semiconductor material, so as to reduce the influence of the off-state leakage current on the stability of the circuit by utilizing this thin film transistor T, and also to ensure a relatively low operating frequency of this thin film transistor T under a high refresh rate, thereby making the pixel circuit 100 having the characteristics of low off-state leakage and low power consumption.

In a feasible implementation manner, referring to FIG. 7 again, the switch unit 1 includes at least one first-type switch unit 10, and the first-type switch unit 10 is electrically connected to a gate electrode of the driving transistor M0.

During the operation of the pixel circuit 100, a value of a driving current flowing into a light emitting element D depends on a degree of conduction of the driving transistor M0, that is, depending on a gate-source voltage Vgs of the driving transistor M0. The smaller the gate-source voltage Vgs of the driving transistor M0 is, the more fully the driving transistor M0 is turned on, and the greater the value of the driving current flowing into the light-emitting element D is.

Affected by the off-state leakage current, the off-state leakage current of the transistor electrically connected to the gate electrode of the driving transistor M0 will flow to the gate electrode of the driving transistor M0 and will affect a potential of the gate electrode of the driving transistor M0. As a result, the degree of conduction of the driving transistor M0 changes, so that the driving current flowing into the light-emitting element D deviates from its standard value.

In view of the above, in the embodiments of the present disclosure, the first-type switch unit 10 electrically connected to the gate electrode of the driving transistor M0 is provided in the pixel circuit 100, and when the thin film transistor T in the first-type switch unit 10 is an oxide transistor, the thin film transistor T in the first-type switch unit 10 can be used to reduce the influence of the off-state leakage current on the potential of the gate electrode of the driving transistor M0, thereby improving the reliability of the light-emitting brightness. At the same time, the thin film transistor T in the first-type switch unit 10 can also achieve a relative low power consumption.

In a feasible implementation manner, referring to FIG. 7 again, the thin film transistor T includes a first thin film transistor T1, and the first thin film transistor T1 can be an oxide transistor. The first-type switch unit 10 includes a gate reset unit 2, and the gate reset unit 2 includes M first thin film transistors T1 connected in parallel.

A first electrode of the first thin film transistor T1 is electrically connected to a first reset signal line Vref1, a second electrode of the first thin film transistor T1 is electrically connected to the gate electrode of the driving transistor M0, and the gate electrodes of the M first thin film transistors T1 are connected to M first scanning signal lines Scan1 in one-to-one correspondence. The M first scanning signal lines Scan1 are respectively configured to provide effective levels for controlling the first thin film transistors T1 to be turned on during different display phases.

For the convenience of understanding, the M first thin film transistors T1 shown in the drawings are represented by reference signs T1_1 to T1_M, respectively, and correspondingly, the first scanning signal line Scan1 electrically connected to the first thin film transistor T1_*i* is represented by a reference sign Scan1_*i*, where $1 \le i \le M$.

Figure 8:
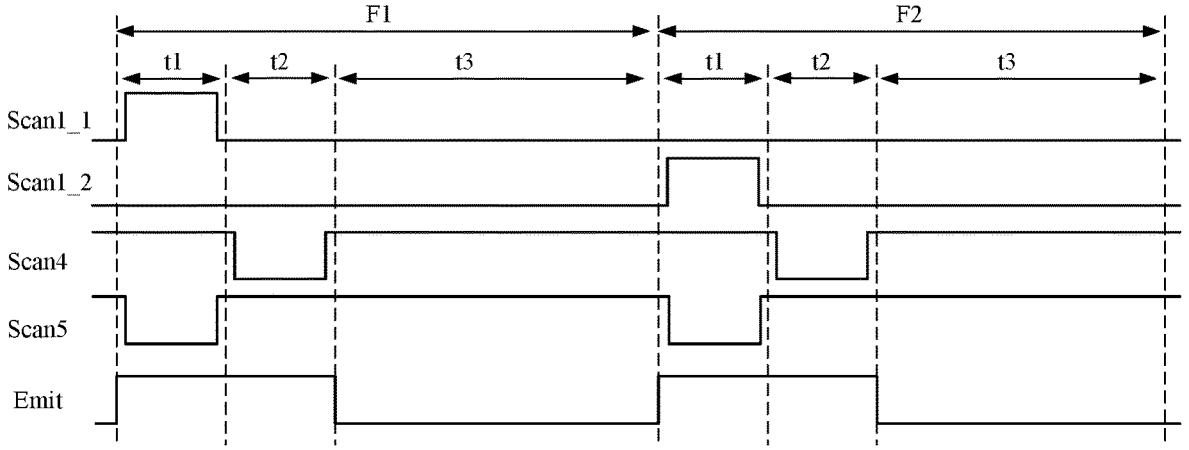
FIG. 8 is a timing sequence corresponding to FIG. 7.

In an example where M=2, the display phase includes one frame period, the first one of the two first thin film transistors T is turned on during an odd-numbered frame period, and the second one of the two first thin film transistors T is turned on during an even-numbered frame period, as shown in FIG. 8. That is, in a timing sequence corresponding to FIG. 7, during the reset phase t1 of the first frame period F1 the first scanning signal line Scan1_1 provides an effective level (high level), the first scanning signal line Scan1_2 provides an ineffective level (low level), and the first thin film transistor T1_1 is turned on in response to the high level to transmit a first reset signal provided by a first reset signal line Vref1 to the gate electrode of the drive transistor M0. During the reset phase t1 of the second frame period F2, the first scanning signal line Scan1_1 provides an ineffective level (low level), the first scanning signal line Scan1_2 provides an effective level (high level), and the first thin film transistor T1_2 is turned on in response to the high level to transmit the first reset signal provided by the first reset signal line Vref1 to the gate electrode of the drive transistor M0.

In the embodiments of the present disclosure, at least two first scanning signal lines Scan1 respectively provide effective levels during different display phases, which can control the first thin film transistor T1 to be turned on during at least one display phase and to be turned off during at least one another display phase. In this way, the operating frequency of each first thin film transistor T1 is smaller than the refresh rate of the display panel, which reduces the power consumption of the first thin film transistor T1. At the same time, since the first thin film transistor T1 is electrically connected to the gate electrode of the driving transistor M0, the first thin film transistor T1 can also be used to reduce the influence of the off-state leakage current on the potential of the gate electrode of the driving transistor M0, which improves the stability of the operation state of the driving transistor M0.

In the pixel circuit 100, the off-state leakage current of the transistor electrically connected to the gate electrode of the driving transistor M0 affects the accuracy of the light-emitting brightness, and the off-state leakage of the transistor electrically connected to the anode of the light-emitting element D can also affect the display performance. For example, when the light-emitting element D does not need to emit light, ideally, the light-emitting element D will not emit light completely. However, if the off-state leakage current of the transistor electrically connected to the anode of the light-emitting element D is large, this off-state leakage current will flow to the anode of the light-emitting element D, which causes the light-emitting element D to be turned off incompletely, make the light-emitting element D emit undesired light, and thus causing undesirable phenomena of the image displayed on the display panel, such as flickering.

Figure 9:
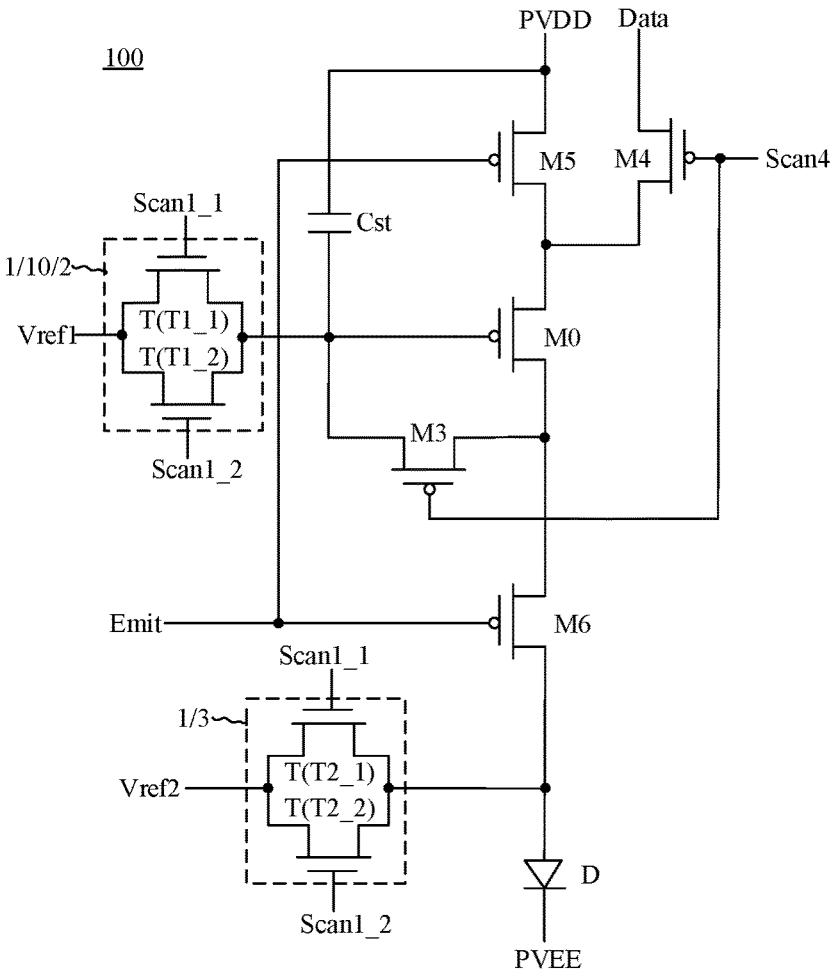
FIG. 9 is a schematic diagram of a pixel circuit provided by another embodiment of the present disclosure.

As shown in FIG. 9 that is a schematic diagram of a pixel circuit provided by another embodiment of the present disclosure, the thin film transistor T includes a second thin film transistor T2, which can be an oxide transistor. The switch unit 1 can include an anode reset unit 3. The anode reset unit 3 includes K1 second thin film transistors T2 connected in parallel, where K1 is a positive integer greater than or equal to 2. The K1 second thin film transistors T2 are turned on during different display phases, respectively.

A first electrode of the second thin film transistor T2 is electrically connected to a second reset signal line Vref2, a second electrode of the second thin film transistor T2 is electrically connected to the anode of the light-emitting element D, and a gate electrode of the second thin film transistor T2 is electrically connected to the first scanning signal line Scan1.

In an embodiment of the present disclosure, K1 can be smaller than or equal to M. When K1<M, gate electrodes of the K1 second thin film transistors T2 can be electrically connected to K1 first scanning signal lines Scan1 of the M first scanning signal lines Scan1 in one-to-one correspondence. When K1=M, the gate electrodes of the K1 second thin film transistors T2 are electrically connected to the M first scanning signal lines Scan1 in one-to-one correspondence.

The drawings in the embodiments of the present disclosure are illustrated by taking K1=M as an example. For better understanding, the M second thin film transistors T2 shown in the drawings are respectively represented by reference signs T2_1 to T2_M, and the second thin film transistor T2 electrically connected to a scanning signal line Scan1_*i* is denoted with a reference sign T2_*i*.

Figure 10:
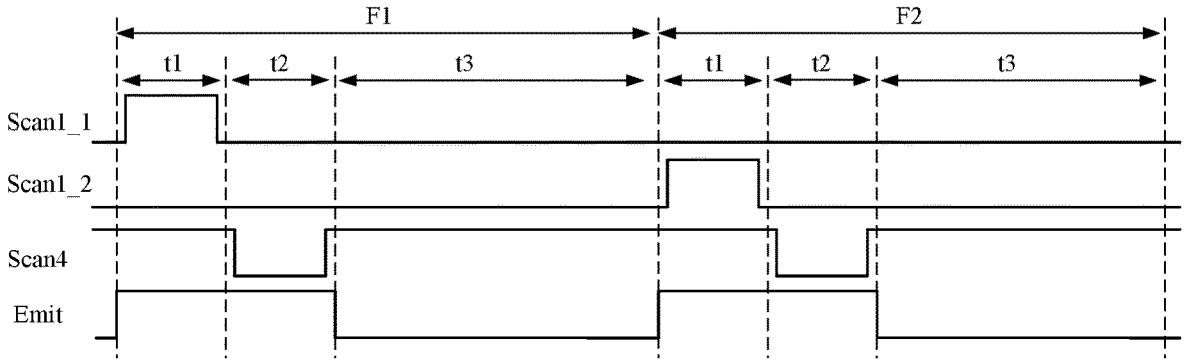
FIG. 10 is a timing sequence corresponding to FIG. 9.

FIG. 10 is a timing sequence corresponding to FIG. 9. Taking K1=M=2 and taking the display phase including one frame period as an example, as shown in FIG. 10, during a reset stage t1 of a first frame period F1, the first scanning signal line Scan1_1 provides an effective level (high level), the first scanning signal line Scan1_2 provides an ineffective level (low level), the first thin film transistor T1_1 and the second thin film transistor T2_1 are turned on in response to the high level, to respectively transmit the first reset signal provided by the reset signal line Vref1 to the gate electrode of the driving transistor M0 and a second reset signal provided by a second reset signal line Vref2 to the anode of the light-emitting element D.

During a reset phase t1 of a second frame period F2, the first scanning signal line Scan1_1 provides an ineffective level (low level), the first scanning signal line Scan1_2 provides an effective level (high level), and the first thin film transistor T1_2 and the second thin film transistor T2_2 are turned on in response to the high level, to respectively transmit the first reset signal provided by the first reset signal line Vref1 to the gate electrode of the driving transistor M0, and the second reset signal provided by the second reset signal line Vref2 to the anode of the light-emitting element D.

With such a configuration, the second thin film transistor T2 can be used to address the problem of emitting undesired light of the light-emitting element D, and at the same time, the second thin film transistor T2 can operate at a lower frequency, thereby reducing the overall power consumption of the pixel circuit 100. By reusing the scanning signal line connected to the second thin film transistor T2 as the scanning signal line connected to the first thin film transistor T1, so that there is no need to provide additional scanning signal line for the second thin film transistor T2, thereby reducing the wiring complexity and the space of the signal lines occupied in the display panel.

In an embodiment of the present disclosure, with reference to FIG. 7 and FIG. 8, the anode reset transistor M2 electrically connected to the gate electrode of the driving transistor M0 can also be a low temperature poly-silicon transistor. In this case, the anode reset transistor M2 is electrically connected to a single fifth scanning signal line Scan5, and the fifth scanning signal line Scan5 is configured to provide a low level during the reset phase t1 of each frame period.

Figure 11:
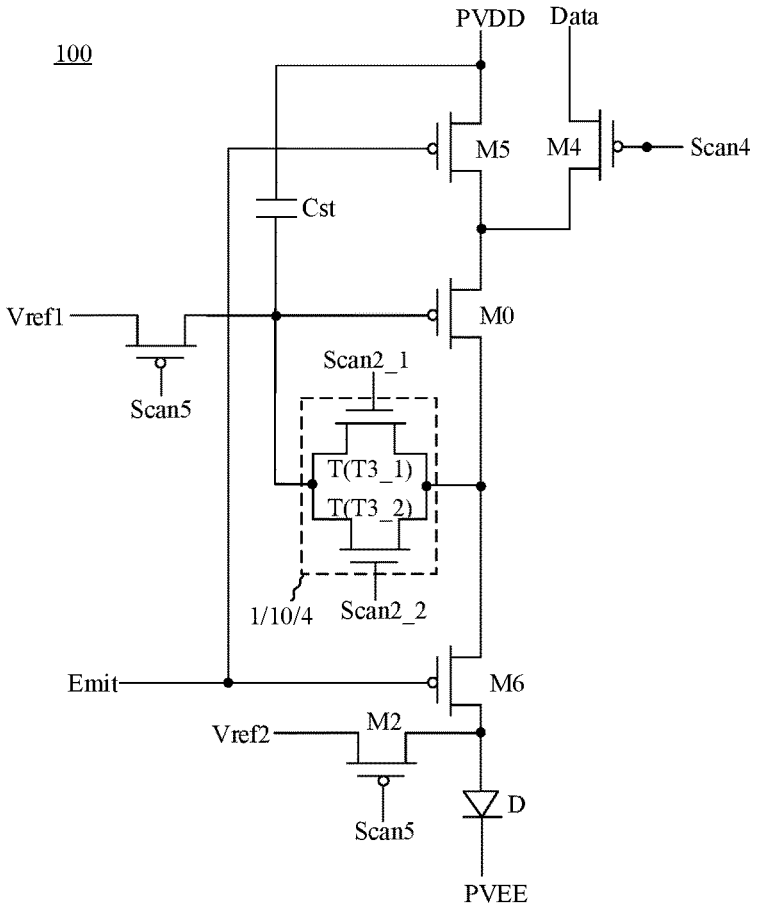
FIG. 11 is a schematic diagram of a pixel circuit provided by another embodiment of the present disclosure.

FIG. 11 is a schematic diagram of a pixel circuit provided by another embodiment of the present disclosure. In a feasible implementation manner, as shown in FIG. 11, the thin film transistor T includes a third thin film transistor T3, and the third thin film transistor T3 can be an oxide transistor. The first-type switch unit 10 includes a threshold compensation unit 4, and the threshold compensation unit 4 includes M third thin film transistors T3 connected in parallel.

A first electrode of the third thin film transistor T3 is electrically connected to the second electrode of the driving transistor M0, a second electrode of the third thin film transistor T3 is electrically connected to the gate electrode of the driving transistor M0, and the gate electrodes of the M third thin film transistors T3 are electrically connected to the M second scanning signal lines Scan2 in one-to-one correspondence. The M second scanning signal lines Scan2 are configured to provide effective levels for controlling the third thin film transistor T3 to be turned on during different display phases, respectively.

For the convenience of understanding, the M third thin film transistors T3 shown in the drawings are represented by reference signs T3_1 to T3_M, respectively, and correspondingly, the second scanning signal line Scan2 electrically connected to the third thin film transistor T3_*i* is represented with a reference sign Scan2_*i*.

Figure 12:
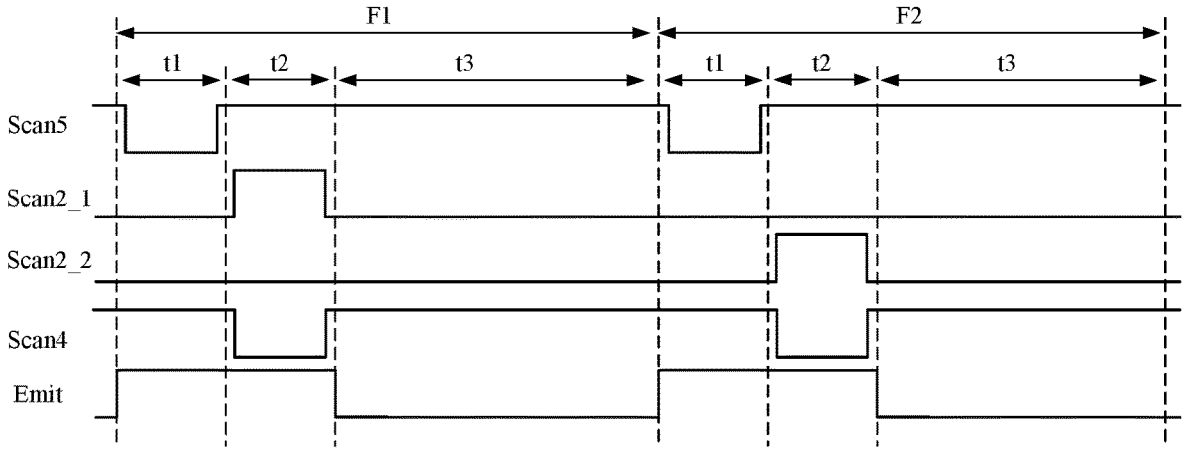
FIG. 12 is a timing sequence corresponding to FIG. 11.

In an example where M=2, the display phase includes one frame period, a first one of the two third thin film transistors T3 is turned on during an odd-numbered frame period, and a second one of the two third thin film transistors T3 is turned on during an even-numbered frame period. As shown in FIG. 12 that is a timing sequence corresponding to FIG. 11, during a data writing stage t2 of a first frame period F1, a second scanning signal line Scan2_1 provides an effective level (high level), a second scanning signal line Scan2_2 provides an ineffective level (low level), and a third thin film transistor T3_1 is turned on in response to the high level to write a potential of the second electrode of the driving transistor M0 to the gate electrode of the drive transistor M0. During a reset phase t1 of a second frame F2, the second scanning signal line Scan2_1 provides an ineffective level (low level), the second scanning signal line Scan2_2 provides an effective level (high level), and the third thin film transistor T3_2 is turned on in responds to the high level to write the potential of the second electrode of the driving transistor M0 to the gate electrode of the driving transistor M0.

In the embodiments of the present disclosure, the M second scanning signal lines Scan2 respectively provide effective levels during different display phases, and each third thin film transistor T3 can be controlled to be turned on only during at least one display phase and to be turned off during at least one another display phase, so that the operating frequency of each third thin film transistor T3 is smaller than the refresh rate of the display panel, thereby reducing the power consumption of the third thin film transistor T3. At the same time, the third thin film transistor T3 is electrically connected to the gate electrode of the driving transistor M0, so the third thin film transistor T3 can also be used to reduce the influence of the off-state leakage current on the gate electrode of the potential of the driving transistor M0, which improves the stability of the operation state of the driving transistor M0.

Figure 13:
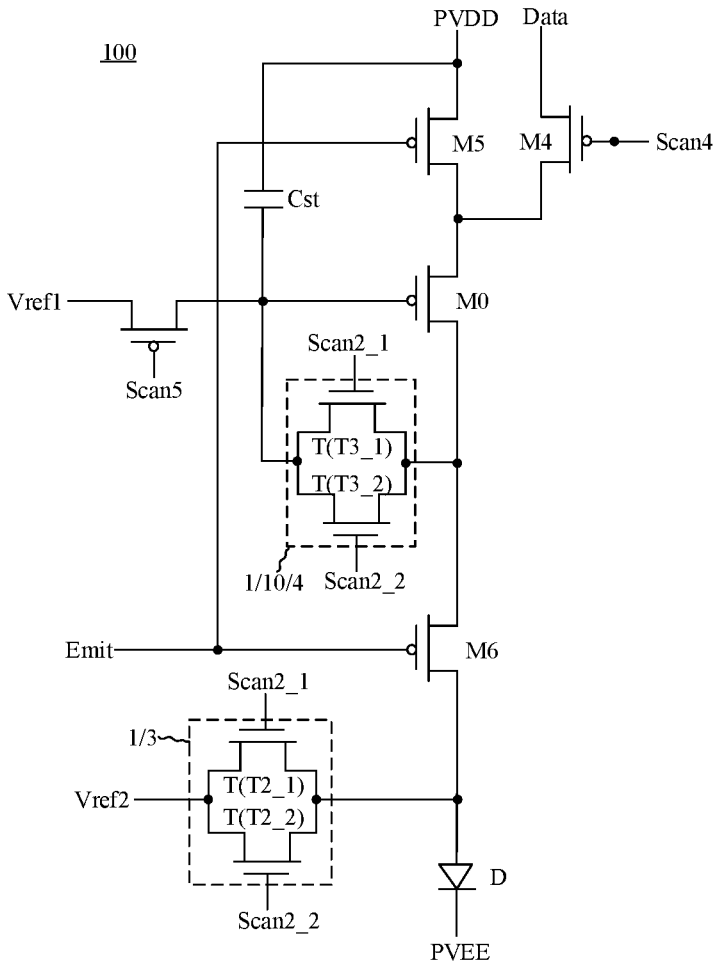
FIG. 13 is a schematic diagram of a pixel circuit provided by another embodiment of the present disclosure.

FIG. 13 is a schematic diagram of a pixel circuit provided by another embodiment of the present disclosure. In an embodiment, as shown in FIG. 3, the thin film transistor T includes a second thin film transistor T2. The second thin film transistor T2 can be an oxide transistor. The switch unit 1 can include an anode reset unit 3. The anode reset unit 3 includes K2 second thin film transistors T2 connected in parallel, where K2 is a positive integer greater than or equal to 2. The K2 second thin film transistors T2 are turned on during different display phases, respectively.

A first electrode of the second thin film transistor T2 is electrically connected to the second reset signal line Vref2, a second electrode of the second thin film transistor T2 is electrically connected to the anode of the light-emitting element D, and a gate electrode of the second thin film transistor T2 is electrically connected to the scanning signal line Scan2.

In an embodiment of the present disclosure, K2 can be smaller than or equal to M. In a case where K2<M, the gate electrodes of the K2 second thin film transistors T2 can be electrically connected to the K2 second scanning signal lines Scan2 of the M second scanning signal lines Scan2 in one-to-one correspondence. In a case where K2=M, the gate electrodes of the K1 second thin film transistors T2 are electrically connected to the M second scanning signal lines Scan2 in one-to-one correspondence.

The drawings in the embodiments of the present disclosure are illustrated with K2=M as an example. For the convenience of understanding, the second thin film transistor T2 electrically connected to the second scanning signal line Scan2_*i* is denoted with a reference sign T2_*i*.

Taking K2=M=2 and the display phase including one frame period as an example, with reference to FIG. 12, during the data writing stage t2 of the first frame period F1, the second scanning signal line Scan2_1 provides an effective level (high level), the second scanning signal line Scan2_2 provides an ineffective level (low level), the third thin film transistor T3_1 is turned on in response to the high level to writes a voltage of the second electrode of the driving transistor M0 to the gate electrode of the driving transistor M0, and the second thin film transistor T3_1 is turned on in response to the high level to transmit the second reset signal provided by the second reset signal line Vref2 to the anode of the light-emitting element D.

During the data writing phase t2 of the second frame period F2, the second scanning signal line Scan2_1 provides an ineffective level (low level), the second scanning signal line Scan2_2 provides an effective level (high level), and the third thin film transistor T3_2 is turned on in response to the high level to write the voltage of the second electrode of the driving transistor M0 to the gate electrode of the driving transistor M0, and the second thin film transistor T2_2 is turned on in response to the high level to transmit the second reset signal provided by the second reset signal line Vref2 to the anode of the light-emitting element D.

With the above structure, the second thin film transistor T2 can be used to address the problem of emitting undesired light of the light-emitting element D, and at the same time, the second thin film transistor T2 can operate at a relatively low frequency, thereby reducing the overall power consumption of the pixel circuit 100. By reusing the scanning signal line connected to the second thin film transistor T2 as the scanning signal line connected to the third thin film transistor T3, so that there is no need to provide an additional scanning signal line for the second thin film transistor T2, thereby reducing the wiring complexity and the space of the signal lines occupied in the display panel.

Figure 14:
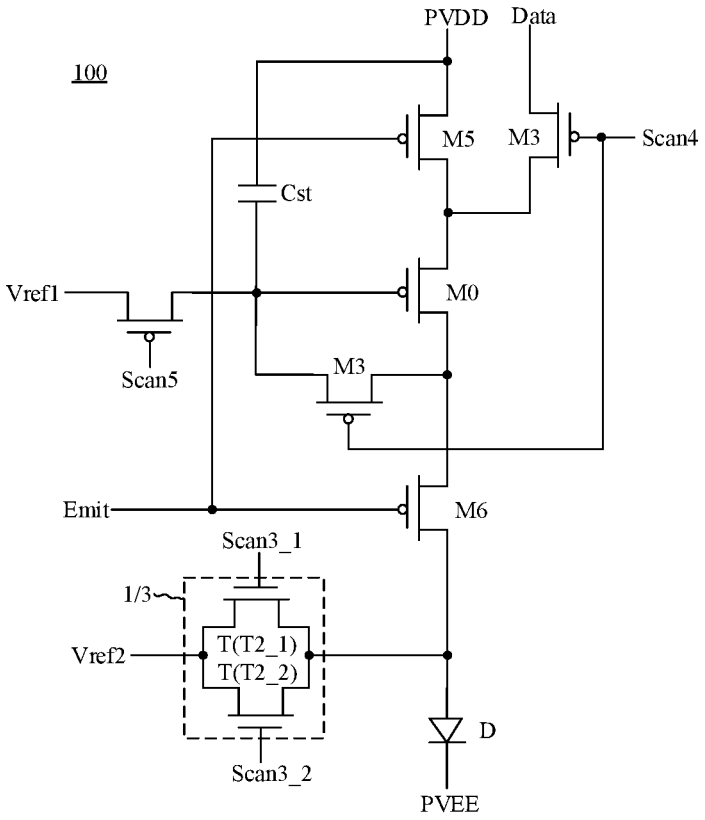
FIG. 14 is a schematic diagram of a pixel circuit provided by another embodiment of the present disclosure.

FIG. 14 is a schematic diagram of a pixel circuit provided by another embodiment of the present disclosure. In an embodiment, as shown in FIG. 14, the thin film transistor T includes a second thin film transistor T2. The second thin film transistor T2 can be an oxide transistor, that is, an active layer of the second thin film transistor T2 includes an oxide semiconductor material. The switch unit 1 includes an anode reset unit 3. The anode reset unit 3 includes M second thin film transistors T2 connected in parallel.

A first electrode of the second thin film transistor T2 is electrically connected to the second reset signal line Vref2, a second electrode of the second thin film transistor T2 is electrically connected to the anode of the light-emitting element D, and gate electrodes of the M second thin film transistors T2 are electrically connected to the M third scanning signal lines Scan3 in one-to-one correspondence. The M third scanning signal lines Scan3 are used to respectively provide effective levels for controlling the second thin film transistor T2 to be turned on during different display phases. For ease of understanding, the third scanning signal line Scan3 electrically connected to the second thin film transistor T2_*i* is denoted with a reference sign Scan3_*i*.

Figure 15:
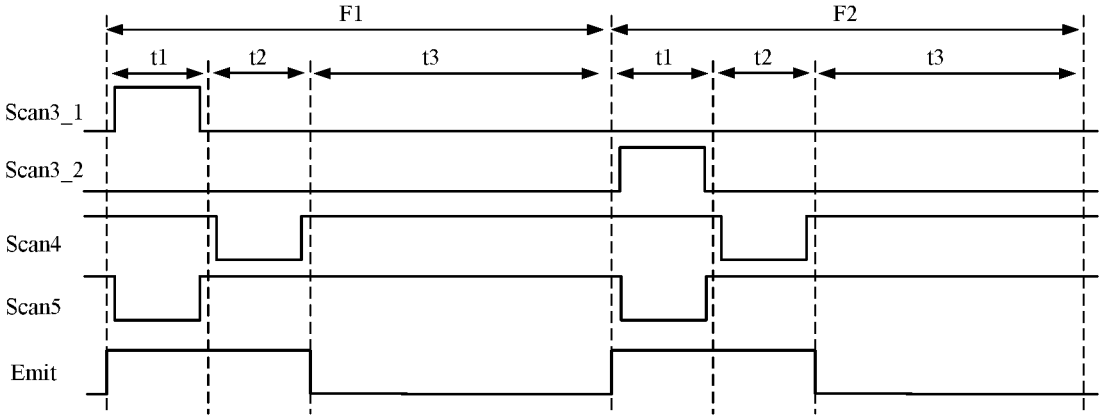
FIG. 15 is a timing sequence corresponding to FIG. 14.

In an example where M=2, the display phase includes one frame period, a first one of the two second thin film transistors T2 is turned on in an odd-numbered frame period, and a second one of the two second thin film transistors T2 is turned on in an even-numbered frame period. As shown in FIG. 15 that is a timing sequence corresponding to FIG. 14, during the reset phase t1 of the first frame period F1, the third scanning signal line Scan3_1 provides an effective level (high level), the third scanning signal line Scan3_2 provides an ineffective level (low level), the second thin film transistor T2_1 is turned on in response to the high level to transmit the second reset signal provided by the second reset signal line Vref2 to the anode of the light-emitting element D.

During the reset phase t1 of the second frame period F2, the third scanning signal line Scan3_1 provides an ineffective level (low level), the third scanning signal line Scan3_2 provides an effective level (high level), and the second thin film transistor T2_2 is turned on in response to the high level to transmit the second reset signal provided by the second reset signal line Vref2 to the anode of the light-emitting element D.

In the embodiments of the present disclosure, the M third scanning signal lines Scan3 provide effective levels during different display phases, respectively, so that each second thin film transistor T2 can be turned on only during some display phases and to be turned off during some other display phases. Therefore, the operating frequency of each second thin film transistor T2 is smaller than the refresh rate of the display panel, which reduces the power consumption of the second thin film transistor T2. At the same time, the second thin film transistor T2 can also be used to reduce the influence of off-state leakage current on the potential of the anode of the light-emitting element D, thereby addressing the problem of emitting undesired light of the light-emitting element D and reducing flickering.

In an embodiment, the second reset voltage provided by the second reset signal line Vref2 is smaller than the first reset voltage provided by the first reset signal line Vref1. At this time, the lower second reset voltage can be used to reset the anode of the light-emitting element D, so that the light-emitting element D will not emit light more completely, thereby avoiding the flickering phenomenon caused by the emitting undesired light of the light-emitting element D.

Figure 16:
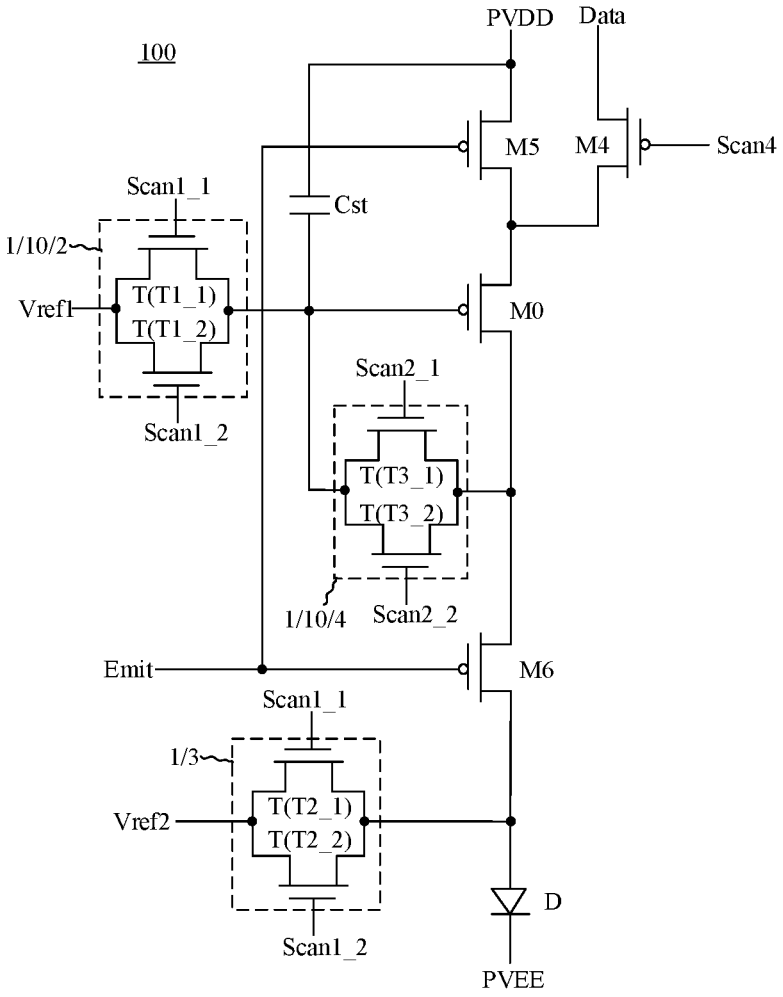
FIG. 16 is a schematic diagram of a pixel circuit provided by another embodiment of the present disclosure.
Figure 17:
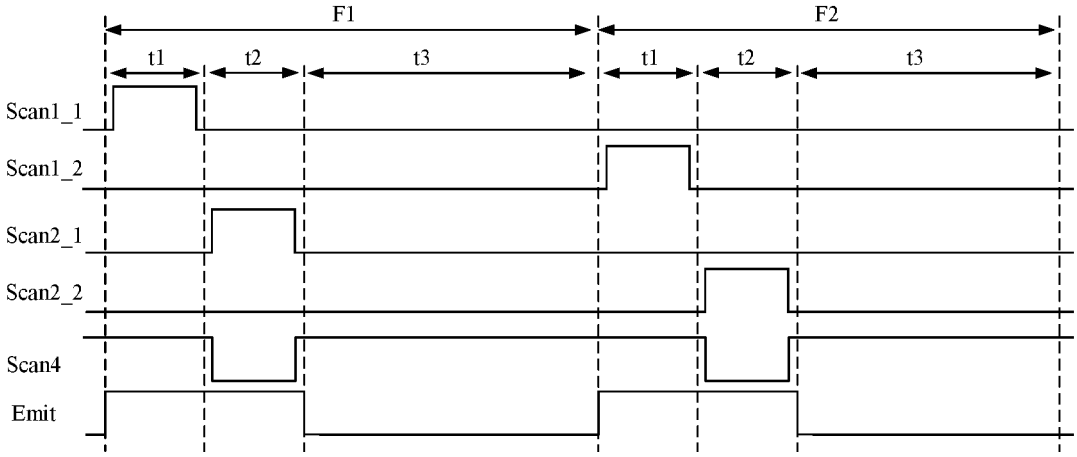
FIG. 17 is a timing sequence corresponding to FIG. 16.

FIG. 16 is a schematic diagram of a pixel circuit provided by another embodiment of the present disclosure, and FIG. 17 is a timing sequence corresponding to FIG. 16. In an embodiment, as shown in FIG. 16 and FIG. 17, the switch unit 1 can further include a gate reset unit 2, an anode reset unit 3, and a threshold compensation unit 4. A gate electrode of a second thin film transistor T2 in the anode reset unit 3 can be electrically connected to the first scanning signal line Scan1, and can also be electrically connected to the second scanning signal line Scan2. The operating principles of the gate reset unit 2, the anode reset unit 3, and the threshold value compensation unit 4 are similar to those of the above-described embodiments, and will not be elaborated herein.

Figure 18:
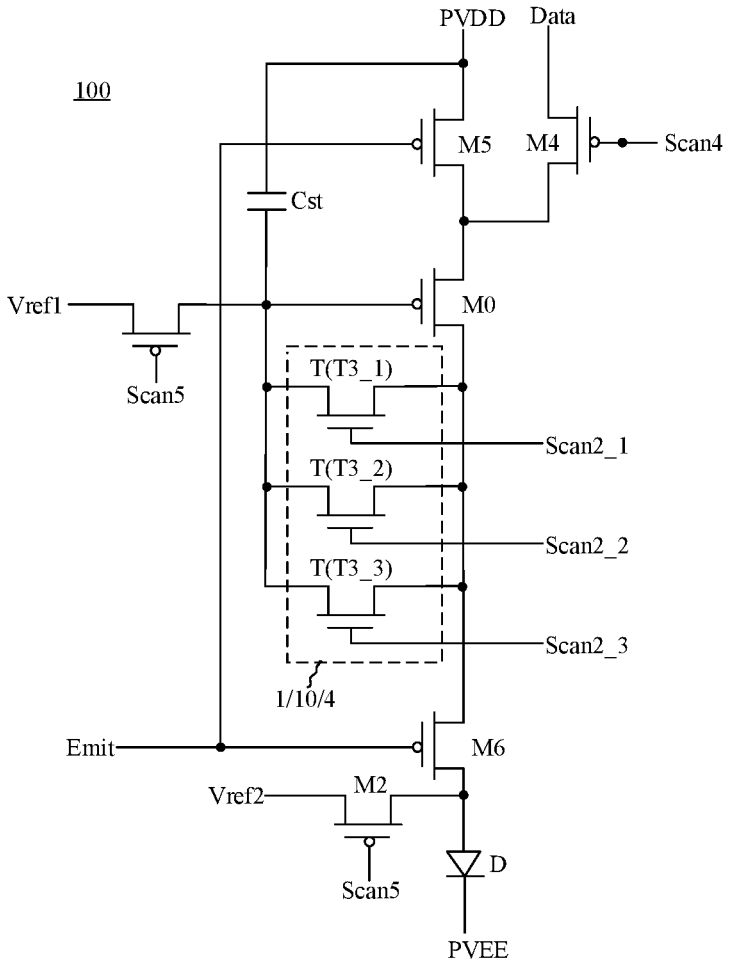
FIG. 18 is a schematic diagram of a pixel circuit provided by another embodiment of the present disclosure.
Figure 19:
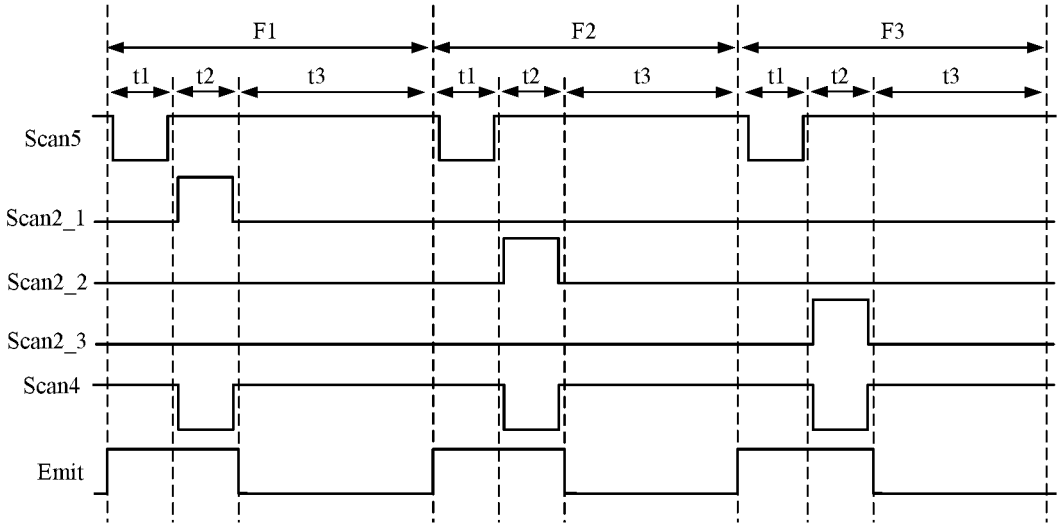
FIG. 19 is a timing sequence corresponding to FIG. 18.
Figure 20:
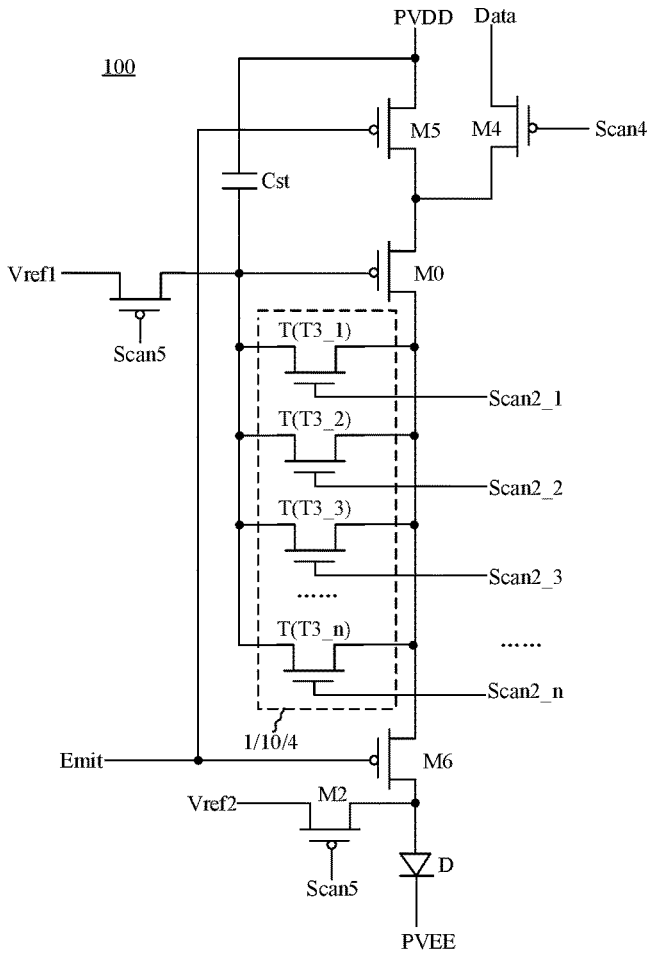
FIG. 20 is another schematic diagram of a pixel circuit provided by another embodiment of the present disclosure.
Figure 21:
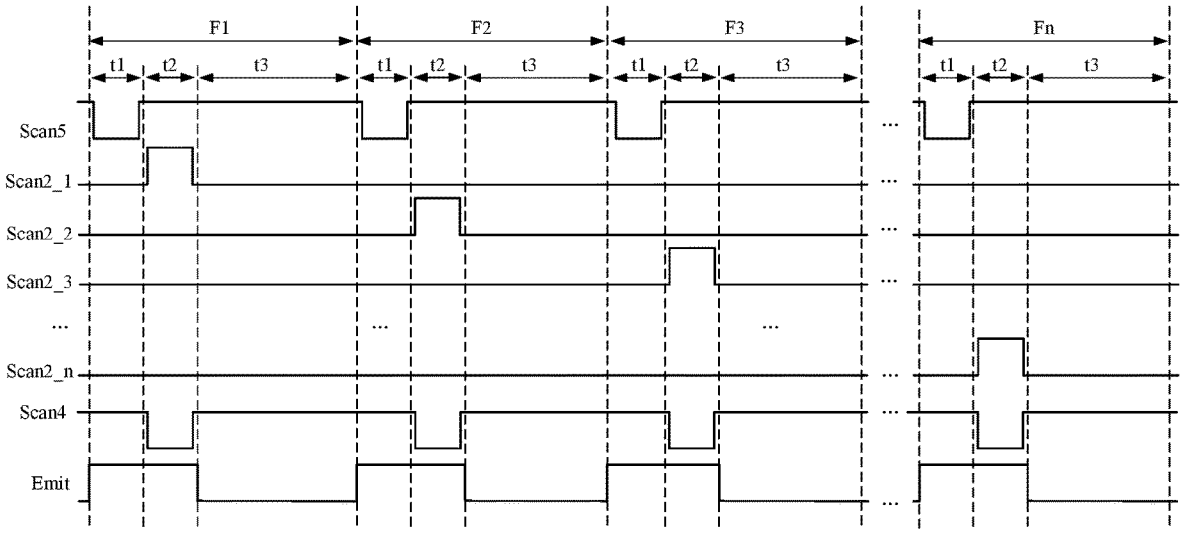
FIG. 21 is a timing sequence corresponding to FIG. 20.

FIG. 18 is a schematic diagram of a pixel circuit provided by another embodiment of the present disclosure, and FIG. 19 is a timing sequence corresponding to FIG. 18. As shown in FIG. 18 and FIG. 19, M can be equal to 3. FIG. 20 is a schematic diagram of a pixel circuit provided by another embodiment of the present disclosure, and FIG. 21 is a timing sequence corresponding to FIG. 20. As shown in FIG. 20 and FIG. 21, M can also be greater than 3. At this time, three or more thin film transistors T are only required to be turned on during different display phases, and the operation principle of the switch unit 1 is similar to the operation principle referred to in the above-mentioned embodiment, which will not be elaborated herein.

Figure 22:
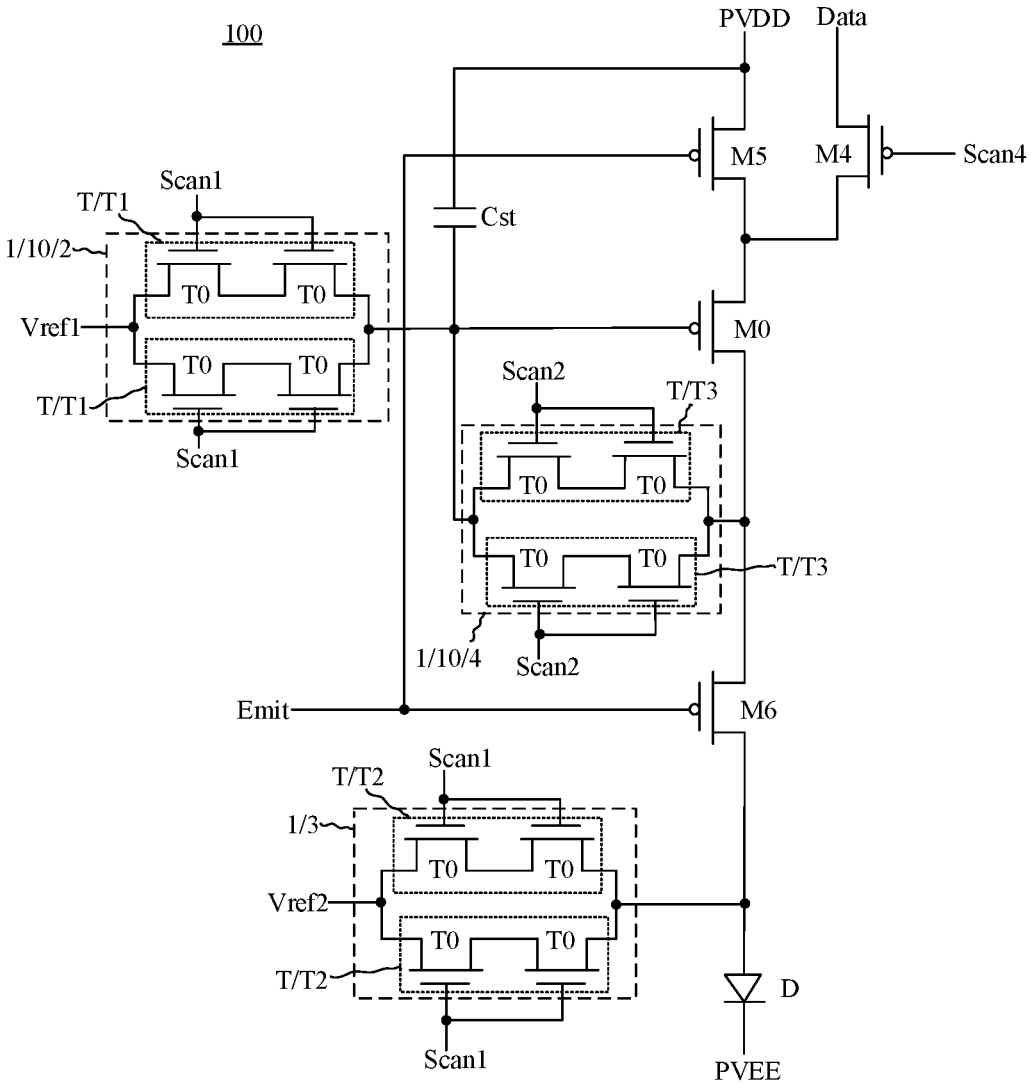
FIG. 22 is a schematic diagram of a thin film transistor provided by another embodiment of the present disclosure.

FIG. 22 is a schematic diagram of a thin film transistor T provided by another embodiment of the present disclosure. In an embodiment, as shown in FIG. 22, at least one thin film transistor T includes P sub-transistors T0 connected in series, where P is a positive integer greater than or equal to 2. Gate electrodes of the P sub-transistors T0 are electrically connected to each other. At this time, each thin film transistor T has a double-gate structure or a multi-gate structure, and a channel length of the thin film transistor T is relatively long, so that the off-state leakage current of the thin film transistor T is reduced, thereby reducing influence of the off-state leakage current on the potential of the gate electrode of the drive transistor M0 and/or the potential of the anode of the light-emitting element D.

In an embodiment, referring to FIG. 4 again, M=2. In this way, when reducing the operating frequency of a single thin film transistor T, it can also be avoided that the switch unit 1 includes an excessive number of thin film transistors T and there is an excessive number of scanning signal lines electrically connected to the thin film transistors T, thereby preventing the pixel circuit 100 from occupying large space.

In an embodiment, referring to FIG. 9 again, the pixel circuit 100 includes at least two switch units 1. The at least two switch units 1 include the same number of thin film transistors T.

With reference to FIG. 9, when the switch unit 1 includes the gate reset unit 2 and the anode reset unit 3, and when the number of the first thin film transistors T1 in the gate reset unit 2 is equal to the number of the second thin film transistors T2 in the anode reset unit 3, the number of scanning signal lines electrically connected to the first thin film transistor T1 is equal to the number of scanning signal lines electrically connected to the second thin film transistor T2, so that the two types of scanning signal lines can be better reused.

In other embodiments of the present disclosure, the pixel circuit 100 includes at least two switch units 1, and the number of the thin film transistors T in one of the at least two switch units 1 can be different from the number of the thin film transistors T in another one of the at least two switch units 1.

Figure 23:
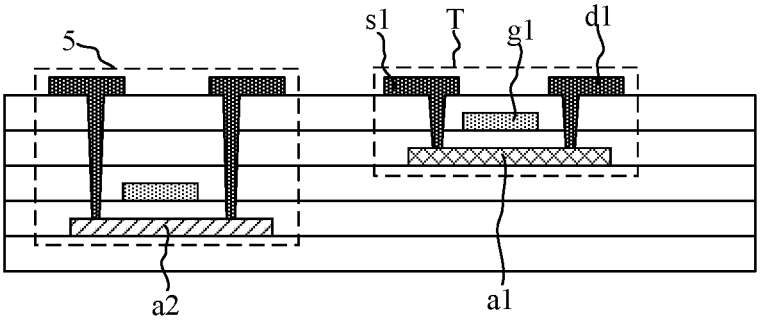
FIG. 23 is a schematic diagram of a layer structure of a thin film transistor provided by an embodiment of the present disclosure.

FIG. 23 is a schematic diagram of a layer structure of a thin film transistor according to an embodiment of the present disclosure. In an embodiment, as shown in FIG. 23, the thin film transistor T includes an active layer a1, a gate electrode g1 located on a side of the active layer a1, and a source electrode s1 and a drain electrode dl that are located on a side of the gate electrode g1 facing away from the active layer a1. The active layer a1 includes an oxide semiconductor material, that is, the thin film transistor T is an oxide transistor. The source electrode s1 and the drain electrode dl are electrically connected to the active layer a1, respectively. In an embodiment, the thin film transistor T has a top-gate structure.

In an embodiment of the present disclosure, referring to FIG. 23 again, some transistors in the pixel circuit 100 can also be low temperature poly-silicon transistors 5, that is, the active layers a2 of these transistors are made of the low temperature poly-silicon material. In this case, the active layer a1 of the thin film transistor T can be located on a side of the active layer a2 of the low temperature poly-silicon transistor 5 towards a light-emitting direction of the display panel, thereby avoiding that the doping process of the active layer a2 of the low temperature poly-silicon transistor 5 affects the performance of the active layer a1.

Figure 24:
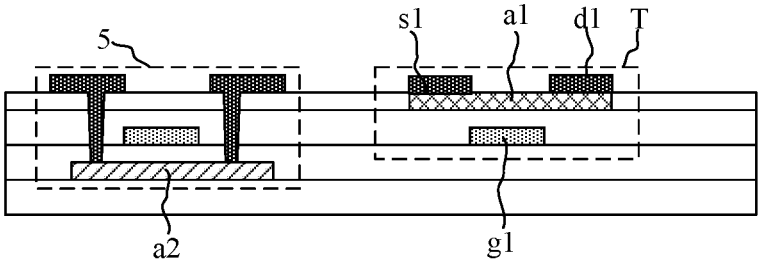
FIG. 24 is a schematic diagram of another layer structure of a thin film transistor provided by the embodiment of the present disclosure.

FIG. 24 is a schematic diagram of another layer structure of a thin film transistor provided by an embodiment of the present disclosure. In an embodiment, as shown in FIG. 24, the thin film transistor T includes a gate electrode g1, an active layer a1, a source electrode s1 and a drain electrode dl. The active layer a1 is located on a side of the gate electrode g1. The source electrode s1 and the drain electrode dl are located on a side of the active layer facing away from the gate electrode. The active layer a1 includes an oxide semiconductor material, that is, the thin film transistor T is an oxide transistor. A surface of the source electrode s1 facing the gate electrode is in contact with a surface of the active layer facing away from the gate electrode, and a surface of the drain electrode dl facing the gate electrode is in contact with the surface of the active layer facing away from the gate electrode.

In the above configuration, the thin film transistor T has a bottom gate structure, and the gate electrode g1 is located at a side of the active layer a1 away from the light-emitting direction of the display panel. In this case, the gate electrode g1 can serve as a light-shielding layer to shield incident light from a bottom of the display panel to irradiating to the channel, thereby preventing the device performance of the thin film transistor T from being affected. With such configuration, the source electrode s1 and the drain electrode dl of the thin film transistor T can be electrically connected to each other by directly contacting the surface of the active layer a1, reaching a relatively high connection reliability.

In an embodiment, referring to FIG. 4 again, the pixel circuit 100 further includes a data writing transistor M4, a first light-emitting control transistor M5, and a second light-emitting control transistor M6.

Agate electrode of the data writing transistor M4 is electrically connected to a fourth scanning signal line Scan4, a first electrode of the data writing transistor M4 is electrically connected to the data line Data, and a second electrode of the data writing transistor M4 is electrically connected to the first electrode of the driving transistor M0. The data writing transistor M4 is configured to write a data signal provided by the data line Data to the first electrode of the driving transistor M0 during the data writing phase t2.

A gate electrode of the first light-emitting control transistor M5 is electrically connected to a light-emitting control signal line Emit, and a first electrode of the first light-emitting control transistor M5 is electrically connected to a power supply signal line PVDD. A second electrode of the data writing transistor M4 is electrically connected to the driving transistor M0. A first electrode of the second light-emitting control transistor M6 is electrically connected to the second electrode of the driving transistor M0, and a second electrode of the second light-emitting control transistor M6 is electrically connected to the anode of the light-emitting element D. The first light-emitting control transistor M5 and the second light-emitting control transistor M6 are configured to conduct a signal transmission path between the power supply signal line PVDD and the anode of the light-emitting element D during the light-emitting control stage t3, and transmit the driving current converted by the driving transistor M0 to the anode of light-emitting element D to drive light-emitting element D to emit light In an embodiment of the present disclosure, the data writing transistor M4, the first light-emitting control transistor M5, and the second light-emitting control transistor M6 can be low temperature poly-silicon transistors.

Based on the above-described concepts, an embodiment of the present disclosure provides a method for driving a display panel. The method is applied to the above-mentioned display panel. With reference to FIG. 4 and FIG. 5, the method for driving the display panel includes: controlling the pixel circuit 100 to drive the light-emitting element D to emit light, and during the operation process of the pixel circuit 100, controlling the M thin film transistors T in the switch unit 1 to be turned on during different display phases.

In the embodiments of the present disclosure, by providing multiple thin film transistors T connected in parallel in the switch unit 1 and controlling the multiple thin film transistors T to be turned on during different display phases, the operating frequency of each thin film transistor T can be reduced, so that the operating frequency of a single thin film transistor T is lower than the refresh rate of the display panel. Even if the display panel is refreshed at a high frequency, the thin film transistor T can still operate at a lower frequency, thereby reducing the power consumption of the thin film transistor T.

In an embodiment, controlling the M thin film transistors T in the switch unit 1 to be turned on during different display phases includes: when a to-be-refreshed frequency of the display panel is greater than a preset refresh rate, controlling the M thin film transistors in the switch unit 1 T to be turned on during different display phases.

The method for driving the display panel can include: when the to-be-refreshed frequency of the display panel is smaller than or equal to the preset refresh rate, controlling only N thin film transistors T in the switch unit 1 to be turned on during different display phases, where N<M.

The preset refresh rate can be 120 Hz, 90 Hz, or 60 Hz.

In the above driving mode, when the display panel is refreshed at high frequency, by controlling the M thin film transistors T in the switch unit 1 to be turned on during different display phases, the operating frequency of a single thin film transistor T can be reduced and its power consumption can be reduced. When the display panel is refreshed at a low frequency, only some of the thin film transistors T in the switch unit 1 can be controlled to be turned on during different display phases, while the remaining thin film transistors T of the thin film transistors T do not work. The operated thin film transistors T of the thin film transistors T can still ensure a lower operating frequency to avoid large power consumption.

In an embodiment, N=1, that is, when the to-be-refreshed frequency of the display panel is smaller than or equal to the preset refresh rate, only a certain thin film transistor T in the switch unit 1 is controlled to be turned on during different display phases. At this time, the operating frequency of this thin film transistor T is equal to the refresh rate of the display panel, however, because the refresh rate of the display panel is low, the operating frequency of the thin film transistor T is correspondingly low, and the power consumption is low. By controlling a certain thin film transistor T to work, the driving method is also simple and easy to implement.

In an embodiment, the display phase includes a frame period of a displayed image.

Exemplarily, the switch unit 1 includes two thin film transistors T, a first one of the two thin film transistors T is turned on during an odd-numbered frame period, and a second one of the two thin-film transistors T is turned on during an even-numbered frame period.

In an embodiment, the switch unit 1 includes three thin film transistors T, a first one of the three thin film transistors T is turned on during a $(3n-2)^{th}$ frame period, a second one of the three thin film transistors T is turned on during a $(3n-1)^{th}$ frame period, and a third one of the three thin film transistors T is turned on during a $(3n)^{th}$ frame period, where n takes values of 1, 2, 3, . . . .

With such a control mode, an operating frequency f1 of a single thin film transistor T in the switch unit 1 satisfies $$f1 = \frac{f2}{M},$$

where f2 denotes a refresh rate of the display panel. In this way, the operating frequency of each thin film transistor T can be reduced, thereby reducing the power consumption of each thin film transistor T under a high-frequency driving mode.

In another embodiment, the display phase includes at least two adjacent frame periods.

Exemplarily, the switch unit 1 includes two thin film transistors T, a first one of the two thin film transistors T is turned on during a first frame period to an $m^{th}$ frame period, a second one of the two thin film transistors T is turned on during an $(m+1)^{th}$ frame period to a $(2m)^{th}$ frame period, the first one of the two thin film transistors T is turned on during a $(2m+1)^{th}$ frame period to a $(3m)^{th}$ frame period, the second one of the two thin film transistors T is turned on during a $(3m+1)^{th}$ frame period to a $(4m)^{th}$ frame period, and so on.

In an embodiment, the switch unit 1 includes three thin film transistors T, a first one of the three thin film transistors T is turned on during a first frame period to an $m^{th}$ frame period, a second one of the three thin film transistors T is turned on during a $(m+1)^{th}$ frame period to $(2m)^{th}$ frame period, a third one of the three thin film transistors T is turned on during a (2m+1), frame period to a $(3m)^{th}$ frame period, the first one of the three thin film transistors T is turned on during a $(3m+1)^{th}$ frame period to a $(4m)^{th}$ frame period, the second one of the three thin film transistors T is turned on during an $(4m+1)^{th}$ frame period to a $(5m)^{th}$ frame period, the third one of the three thin film transistors T is turned on during a $(5m+1)^{th}$ frame period to a $(6m)^{th}$ frame period, and so on.

Such a control mode can still reduce the operating frequency of each thin film transistor T in the switch unit 1 to be lower than the refresh rate of the display panel, thereby reducing the power consumption of each thin film transistor T under a high frequency driving mode.

Figure 25:
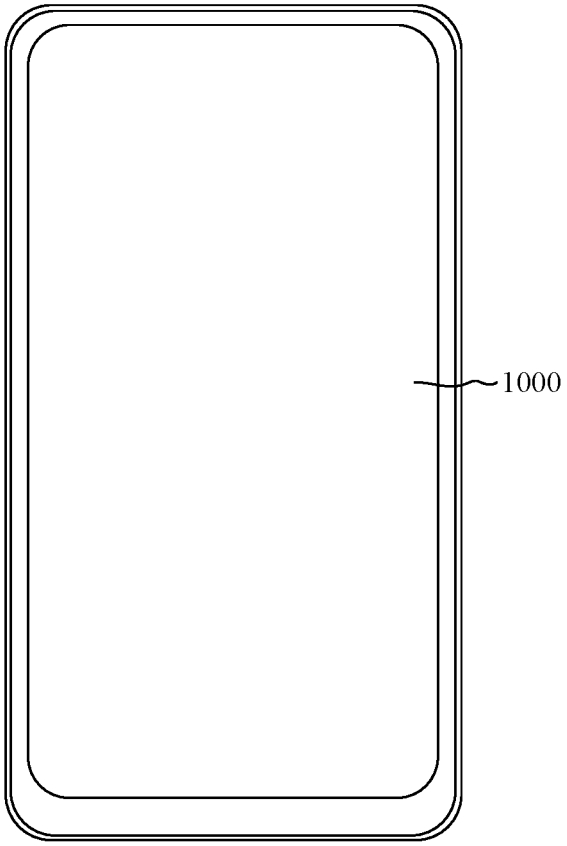
FIG. 25 is a schematic diagram of a display apparatus according to an embodiment of the present disclosure.

Based on a same concept, an embodiment of the present disclosure provides a display apparatus. FIG. 25 is a schematic diagram of a display apparatus provided by an embodiment of the present disclosure. As shown in FIG. 25, the display apparatus includes the above-mentioned display panel 1000. The display apparatus shown in FIG. 25 is only an exemplary illustration, and the display apparatus can be any electronic device with a display function, such as a mobile phone, a tablet computer, a laptop computer, an electronic paper book, or a television.

The above are merely some embodiments of the present disclosure, which, as mentioned above, are not intended to limit the present disclosure. Within the principles of the present disclosure, any modification, equivalent substitution, improvement shall fall into the protection scope of the present disclosure.

Finally, it can be understood that the above embodiments are only used to illustrate the technical solutions of the present disclosure, but not to limit them; although the present disclosure has been described in detail with reference to the foregoing embodiments, those of ordinary skill in the art should understand that the technical solutions described in the foregoing embodiments can still be modified, or some or all of the technical features thereof can be equivalently replaced. These modifications or replacements do not make the essence of the corresponding technical solutions deviate from the scope of the technical solutions of the embodiments of the present disclosure.

What is claimed is:

1. A display panel, comprising a plurality of pixel circuits, wherein each one of the plurality of pixel circuits comprises:

a drive transistor, and at least one switch unit comprising M thin film transistors connected in parallel, where M is a positive integer greater than or equal to 2; and wherein the M thin film transistors are configured for turning on during different display phases, wherein each one of the thin film transistors comprises P sub-transistors connected in series, where P is a positive integer greater than or equal to 2; and wherein gate electrodes of the P sub-transistors are electrically connected to each other.

2. The display panel according to claim 1, wherein individual thin film transistor comprises an active layer comprising an oxide semiconductor material.

3. The display panel according to claim 1, wherein the at least one switch unit comprises at least one first-type switch unit that is electrically connected to a gate electrode of the driving transistor.

4. The display panel according to claim 3, wherein each one of the M thin film transistors comprises a first thin film transistor;

the first-type switch unit comprises a gate reset unit, wherein the gate reset unit comprises M first thin film transistors connected in parallel; and the first thin film transistor comprises a first electrode electrically connected to a first reset signal line, a second electrode electrically connected to a gate electrode of the driving transistor, and a gate electrode; the gate electrodes of M first thin film transistors are electrically connected to M first scanning signal lines in one-to-one correspondence; and the M first scanning signal lines are configured to provide effective levels for controlling the M first thin film transistors during different display phases, respectively.

5. The display panel according to claim 4, wherein each one of the M thin film transistors comprises a second thin film transistor;

the at least one switch unit further comprises an anode reset unit, and the anode reset unit comprises K1 second thin film transistors connected in parallel, where K1 is a positive integer greater than or equal to 2; and the K1 second thin film transistors are configured to be turned on during different display phases; and the second thin film transistor comprises a first electrode electrically connected to a second reset signal line, a second electrode electrically connected to an anode of a light-emitting element, and a gate electrode electrically connected to one of the M first scanning signal lines.

6. The display panel according to claim 5, wherein a second reset voltage provided by the second reset signal line is smaller than a first reset voltage provided by the first reset signal line.

7. The display panel according to claim 3, wherein each one of the M thin film transistors comprises a third thin film transistor;

the first-type switch unit comprises a threshold compensation unit, and the threshold compensation unit comprises M third thin film transistors connected in parallel; and the third thin film transistor comprises a first electrode electrically connected to a second electrode of the driving transistor, a second electrode electrically connected to a gate electrode of the driving transistor, and a gate electrode; the gate electrodes of the M third thin film transistors are electrically connected to M second scanning signal lines in one-to-one correspondence; and the M second scanning signal lines are configured to provide effective levels for controlling the M third thin film transistors to be turned on during different display phases, respectively.

8. The display panel according to claim 7, wherein each one of the M thin film transistors comprises a second thin film transistor;

the at least one switch unit further comprises an anode reset unit, and the anode reset unit comprises K2 second thin film transistors connected in parallel, where K2 is a positive integer greater than or equal to 2; and the K2 second thin film transistors are configured to be turned on during different display phases; and the second thin film transistor comprises a first electrode electrically connected to a second reset signal line, a second electrode electrically connected to an anode of a light-emitting element, and a gate electrode electrically connected to the second scanning signal line.

9. The display panel according to claim 1, wherein each one of the M thin film transistors comprises a second thin film transistor;

the at least one switch unit comprises an anode reset unit, and the anode reset unit comprises M second thin film transistors connected in parallel; and the second thin film transistor comprises a first electrode of electrically connected to a second reset signal line, a second electrode electrically connected to an anode of a light-emitting element, and a gate electrode; the gate electrodes of the M second thin film transistors are electrically connected to M third scanning signal lines in one-to-one correspondence; and the M third scanning signal lines are configured to provide effective levels for controlling the M second thin film transistors to be turned on during different display phases.

10. The display panel according to claim 1, wherein M=2.

11. The display panel according to claim 1, wherein each one of the plurality of pixel circuits comprises at least two switch units, and the at least two switch units comprise a same number of the thin film transistors.

12. The display panel according to claim 1, wherein each one of the M thin film transistors comprises:

an active layer comprising an oxide semiconductor material;

a gate electrode located on a side of the active layer; and a source electrode and a drain electrode that are located on a side of the gate electrode facing away from the active layer, wherein the source electrode and the drain electrode are electrically connected to the active layer; or wherein each one of the M thin film transistors comprises:

a gate electrode;

an active layer located on a side of the gate electrode, the active layer comprising an oxide semiconductor material; and a source electrode and a drain electrode that are located on a side of the active layer facing away from the gate electrode, wherein a surface of the source electrode facing the gate electrode is in contact with a surface of the active layer facing away from the gate electrode; and a surface of the drain electrode facing from the gate electrode is in contact with the surface of the active layer facing away from the gate electrode.

13. The display panel according to claim 1, wherein each one of the plurality of pixel circuits further comprises:

a data writing transistor, wherein the data writing transistor comprises a gate electrode electrically connected to a fourth scanning signal line, a first electrode electrically connected to a data line, and a second electrode electrically connected to a first electrode of the driving transistor;

a first light-emitting control transistor, wherein the first light-emitting control transistor comprises a gate electrode electrically connected to a light-emitting control signal line, a first electrode electrically connected to a power supply signal line, and a second electrode electrically connected to the first electrode of the driving transistor; and a second light-emitting control transistor, wherein the second light-emitting control transistor comprises a gate electrode electrically connected to the light-emitting control signal line, a first electrode electrically connected to a second electrode of the driving transistor, and a second electrode electrically connected to an anode of a light-emitting element.

14. A method for driving a display panel, the display panel comprising a plurality of pixel circuits, wherein each one of the plurality of pixel circuits comprises: a drive transistor, and at least one switch unit comprising M thin film transistors connected in parallel, where M is a positive integer greater than or equal to 2; the M thin film transistors are configured to be turned on during different display phases, wherein each one of the thin film transistors comprises P sub-transistors connected in series, where P is a positive integer greater than or equal to 2; and wherein gate electrodes of the P sub-transistors are electrically connected to each other, the method comprising:

controlling the pixel circuit to drive a light-emitting element to emit light, and, during operation of the pixel circuit, controlling the M thin film transistors in the switch unit to be turned on during the different display phases, respectively, when a to-be-refreshed frequency of the display panel is greater than a preset refresh rate.

15. The driving method according to claim 14, further comprising:

controlling N thin film transistors of the M thin film transistors in the switch unit to be turned on during the different display phases, respectively, when the to-be-refreshed frequency of the display panel is smaller than or equal to the preset refresh rate, where N<M.

16. The driving method according to claim 15, wherein N=1.

17. The driving method according to claim 14, wherein the display phase comprises a frame period of a displayed image.

18. The driving method according to claim 14, wherein the display phase comprises at least two adjacent frame periods.

19. A display apparatus, comprising a display panel, wherein the display panel comprises a plurality of pixel circuits, each one of the plurality of pixel circuits comprises: a drive transistor, and at least one switch unit comprising M thin film transistors connected in parallel, where M is a positive integer greater than or equal to 2; and wherein the M thin film transistors are configured for turning on during different display phases, wherein each one of the thin film transistors comprises P sub-transistors connected in series, where P is a positive integer greater than or equal to 2; and wherein gate electrodes of the P sub-transistors are electrically connected to each other.

* * * * *